US006174208B1

(12) United States Patent
Chen

(10) Patent No.: US 6,174,208 B1
(45) Date of Patent: Jan. 16, 2001

(54) FEMALE TERMINAL FOR A CONNECTOR AND A HOUSING THEREFOR

(75) Inventor: Ping Chen, Mundelein, IL (US)

(73) Assignee: Japan Solderless Terminal Mfg. Co., Ltd., Osaka (JP)

( * ) Notice: Under 35 U.S.C. 154(b), the term of this patent shall be extended for 0 days.

(21) Appl. No.: 09/348,393

(22) Filed: Jul. 7, 1999

(30) Foreign Application Priority Data

Jul. 16, 1998 (JP) ..... 10-219753

(51) Int. Cl.[7] ..... H01R 11/22
(52) U.S. Cl. ..... 439/852; 439/752.5; 439/843
(58) Field of Search ..... 439/852, 851, 439/847, 842, 843, 845, 861, 752.5

(56) References Cited

U.S. PATENT DOCUMENTS 5,860,836 * 1/1999 Ohno ..... 439/852

FOREIGN PATENT DOCUMENTS 8-106944 4/1996 (JP) .
9-055246 2/1997 (JP) .
9-232021 9/1997 (JP) .

* cited by examiner

*Primary Examiner*—Paula Bradley
*Assistant Examiner*—Tho D. Ta
(74) *Attorney, Agent, or Firm*—W. F. Fasse; W. G. Fasse

(57) ABSTRACT

A female terminal for a connector comprising a terminal body that is fixed by a retainer of a housing, a leaf spring that extends forward in the terminal body, and a stabilizer that is fixed by a lance of the housing. At the root end of the leaf spring, a round part that bends lengthwise into an approximately circular arc is formed. A bead having a curved section to increase flexural rigidity of the leaf spring is formed ahead of the round part on the top end side. A stabilizer having a face directed in the width direction is erected in the height direction from the top end of the terminal body.

12 Claims, 13 Drawing Sheets

FEMALE TERMINAL FOR A CONNECTOR AND A HOUSING THEREFOR

BACKGROUND OF THE INVENTION

1. Field of the Invention

The present invention relates to a connector wherein a female terminal is inserted in a chamber of a housing.

2. Related Art

A connector has been known, as shown in FIG. 12A, wherein through chambers 82, in several rows and columns in the directions of height and width, are formed in a housing 81 in parallel to each other, a female terminal 84 being approximately tubular in the front half and being connected to an electric wire 83 in the back is inserted into and fixed in each of the chambers 82, and male terminals of a counterpart connector are inserted into these female terminals 84 to make mechanical connections as well as electrical connections (refer to, for example, Japanese Provisional Patent Hei 8-106944). A port 85 opens in the front end of the above- mentioned female terminal 84 to receive a male terminal. A splicing part 86 is formed in the back of the female terminal 84 to connect an electric wire 83. A concave fixing part 87 is formed in an intermediate part of the female terminal 84. A hook of a lance 88 that is flexibly formed in a chamber 82 of the housing 81 fits into this concave fixing part 87 to provide a primary fixing of the female terminal 84 to the housing 81. Moreover, a fixing piece 90 of a retainer 89 that is fitted into the housing 81 is set at the back of a stabilizer 91 that is formed on the top of the intermediate part of the female terminal 84 to provide a secondary fixing of the female terminal 84 to the housing 81.

Apart from this, a connection structure between a female terminal of this kind and a male terminal has been disclosed in Japanese Provisional Patent Hei 9-232021. As shown in FIG. 12B, to hold an inserted male terminal 92', a leaf spring 93' is integrally formed inside the terminal body 94' of a female terminal 84'.

This leaf spring 93' is blanked out together with the terminal body 94' of a sheet metal and formed by bending the blank. When the material and thickness of the sheet metal are selected by considering formability, cost, etc., it is difficult to secure a sufficient contacting force from the single leaf spring 93'. Hence the above-mentioned Japanese Provisional Patent Hei 9-232021 has disclosed a technology wherein a separate reinforcing leaf spring 95' is blanked out together with the terminal body 94' and this reinforcing leaf spring 95' is bent on the inner side of the main leaf spring 93' to form double springs and ensure a sufficient contacting force. In this case, as each of the leaf springs 93', 95' is formed by bending, a gap is formed between two unrestricted leaf springs due to springbacks. As the dimension of this gap is a cumulative result of steps of forming two springs, it is difficult to accurately control this dimension in the production. It is hard to avoid dispersion in this gap dimension. This poses a problem. At the time of use, the point of inflection of the spring constant at which the main spring 93' contacts the reinforcing spring 95' and both springs 93', 95' start to be deformed varies from product to product. Thus contacting forces are not stable and vary from product to product. Moreover, as the two leaf springs 93', 95' are overlapped with each other, the female terminal 84' becomes bulkier, preventing the ability to make the connector more compact. Furthermore, as shown in FIG. 12B, a round part 96' that is bent into an approximately circular arc is formed near the root end of the leaf spring 93'. When the radius of curvature of this round part 96' is small, cracks may be generated in the round part 96' in use as shown in FIG. 12C. If corrosion develops from these cracks, the contacting force will become extremely unstable.

The above-mentioned stabilizer 91 can exhibit a function of preventing so-called inverse insertion; if the female terminal 84 is inserted into the chamber 82 of the housing 81 in an incorrect orientation, for example, upside down, the stabilizer 91 will catch the entrance of the chamber 82 to prevent further insertion. Because of this function, the female terminal 84 and the retainer 89 are brought to a proper positional relationship and the female terminal 84 is fixed by the retainer 89. However, as the stabilizer is to be fixed by a fixing piece 90 of the retainer 89, the stabilizer is provided on the top of the intermediate part of the terminal body. Accordingly, the front portion of the terminal body ahead of the stabilizer 91, even if it is inverted upside down, would be inserted. This, in turn, would make the assembly worker forcefully insert the female terminal 84 further, resulting in a damage to the chamber and nearby portions of the housing 81.

When a continuity test or the like is to be conducted on to a female terminal of a connector, a test jig having a shape identical to that of a male terminal is inserted into the female terminal. When the test jig is used repeatedly, the jig may be deformed. If such a deformed jig is forced into a female terminal, the lead spring, etc. will be damaged and thus cause trouble.

A connector is used in combination with a counterpart connector. Making the counterpart connector more compact is also desired. If there is an error in assembling a male terminal in the counterpart connector, the male terminal may be assembled to be slightly slanted in relation to the housing. In the worst case, such a male terminal may cause a trouble that it can not be inserted into a female terminal.

SUMMARY OF THE INVENTION

The present invention was made in view of the above-mentioned points. One objective of the present invention is to ensure a stable and sufficient contacting force by forming a bead and increasing the flexural rigidity of a leaf spring and using only a single leaf spring, to move a contacting part of the leaf spring forward, to reduce the length of insertion of a male terminal and make the counterpart connector compact, and to increase the tolerance to slant of the male terminal. Another objective is to prevent cracks, etc. and stabilize the contacting force by giving a larger radius of curvature to the round part in a position beyond the reach of the male terminal. Another objective is to reinforce the function of preventing inverse insertion of the female terminal by shifting the stabilizer forward, and to prevent damage to the leaf spring, etc. by making the stabilizer available to a continuity test, etc. of the female terminal. Furthermore, another objective is to make the connector more compact in the direction of height as much as possible by, in addition to using a single leaf spring and shifting the round part backward, flexing a lance in the direction of width.

To accomplish the above-mentioned objectives, the present invention is a female terminal that is inserted into a chamber of a housing of a connector and receives a male terminal, the female terminal comprising: a terminal body having a tubular front half part that can be inserted into the chamber of the housing, having a port that opens in the front end and receives a male terminal, having a splicing part that is in the back and that is connected to an electric wire, and having a fixing part into which a retainer of the housing fits;

a leaf spring having a root end that is integral to the front half of the body, having a top end that extends forward inside the front half part of the terminal body, and being adopted to be flexed in the direction of height; a stabilizer being erected in the direction of height on the outer side at the front end of the terminal body, having a face in the direction of width, fitting into a groove formed in the longitudinal direction and advancing beyond a lance that is formed in the groove and being fixed by the lance when said terminal proper is inserted into the chamber of the housing; a round part that is formed at the root end of said leaf spring and bent around an axis approximately parallel to said front half part into an approximately circular arc in a position beyond the reach of said male terminal; and a bead that is formed ahead of said round part of said leaf spring on the top end side thereof and has a curved section to increase the flexural rigidity.

According to the present invention, when an electric wire is connected to the splicing part of the terminal body and the female terminal is inserted into a chamber of the housing, the stabilizer will fit into the groove of the housing and advance forward beyond the lance of the housing and will be fixed by the lance. This is the primary fixing of the female terminal to the housing. Next, when a retainer is pushed into the housing, the retainer will fit into the fixing part of the terminal body. This is the secondary fixing of the female terminal to the housing. When a counterpart connector is opposed to the connector and a male terminal of the counterpart connector is inserted into the female terminal, the leaf spring will be pressed to contact the male terminal to make both mechanical connection and electrical connection between the two connectors.

As the bead is formed beyond the round part of the leaf spring on the top end side thereof, the flexural rigidity of the leaf spring is greater and a sufficient contacting force is provided without provision of a reinforcing spring. Moreover, as no reinforcing spring is provided, the spring constant has no point of inflection, and the contacting force of each product is stabilized. Furthermore, as the flexural rigidity of the leaf spring is greater, a sufficient contacting force is generated even if a contacting part of the leaf spring is shifted forward close to the port. As a result, the length of insertion of a male terminal is shortened, and in turn, the housing of the counterpart connector that contains the male terminal is shortened and made more compact. Its tolerance to slant of the male terminal is also increased. Moreover, as the round part is formed in a position beyond the reach of the male terminal, the radius of curvature of the round part can be set larger by extensively using the interior of the front half part of the terminal body in the direction of height. This prevents generation of cracks in the round part and stabilizes the contacting force. As the stabilizer is provided at the front end of the terminal proper, if the female terminal is inserted into a chamber of the housing in a wrong orientation, the stabilizer will catch on the entrance of the chamber in the initial stage of insertion. Thus inverse insertion of the female terminal is prevented reliably, and any damage to the housing due to incorrect operation of the assembly worker can be avoided. Furthermore, if a test window that directly leads to the stabilizer is opened in the front of the housing, when a test jig having a shape identical to that of the male terminal is inserted into the test window, the test jig will contact the stabilizer. Thus a continuity test, etc. can be carried out without causing any damage to the leaf spring, etc. As no reinforcing spring is used, the height of the female terminal is lower, and as the round part is in a position beyond the reach of the male terminal and it does not require any space for a male terminal to move into beneath the leaf spring, the height of the female terminal can be lowered further. Moreover, as the lance of the housing is flexed in the direction of width by the stabilizer having a face set in the direction of width, there is no need of providing a space for flexing in the direction of height of the housing and the height can be reduced. As a result, the connector can be made more compact in the direction of height as much as possible.

When the female terminal for a connector according to the present invention is used, as the flexural rigidity of the leaf spring is increased by the bead, the single leaf spring can stably provide a sufficient contacting force, and the contacting part of the leaf spring can be shifted forward. As this reduces the length of insertion of the male terminal, the counterpart connector can made more compact. In addition to it, the tolerance to slant of the male terminal is increased and the yield of the connectors can be improved. Furthermore, as the radius of curvature of the round part can be increased in a position beyond the reach of the male terminal, generation of cracks, etc. in the leaf spring can be prevented to stabilize the contacting force. As the stabilizer is provided at the front end of the terminal body, inverse insertion of the female terminal can be prevented reliably. Moreover, the stabilizer can be used in conducting a continuity test or the like on the female terminal, and this prevents damage to the leaf spring, etc. Use of a single leaf spring, shifting of the round part backward and flexing of the lance in the direction of width allow to be made of the connector more compact in the direction of height as much as possible.

PREFERRED EMBODIMENTS OF THE INVENTION

Figure 1:
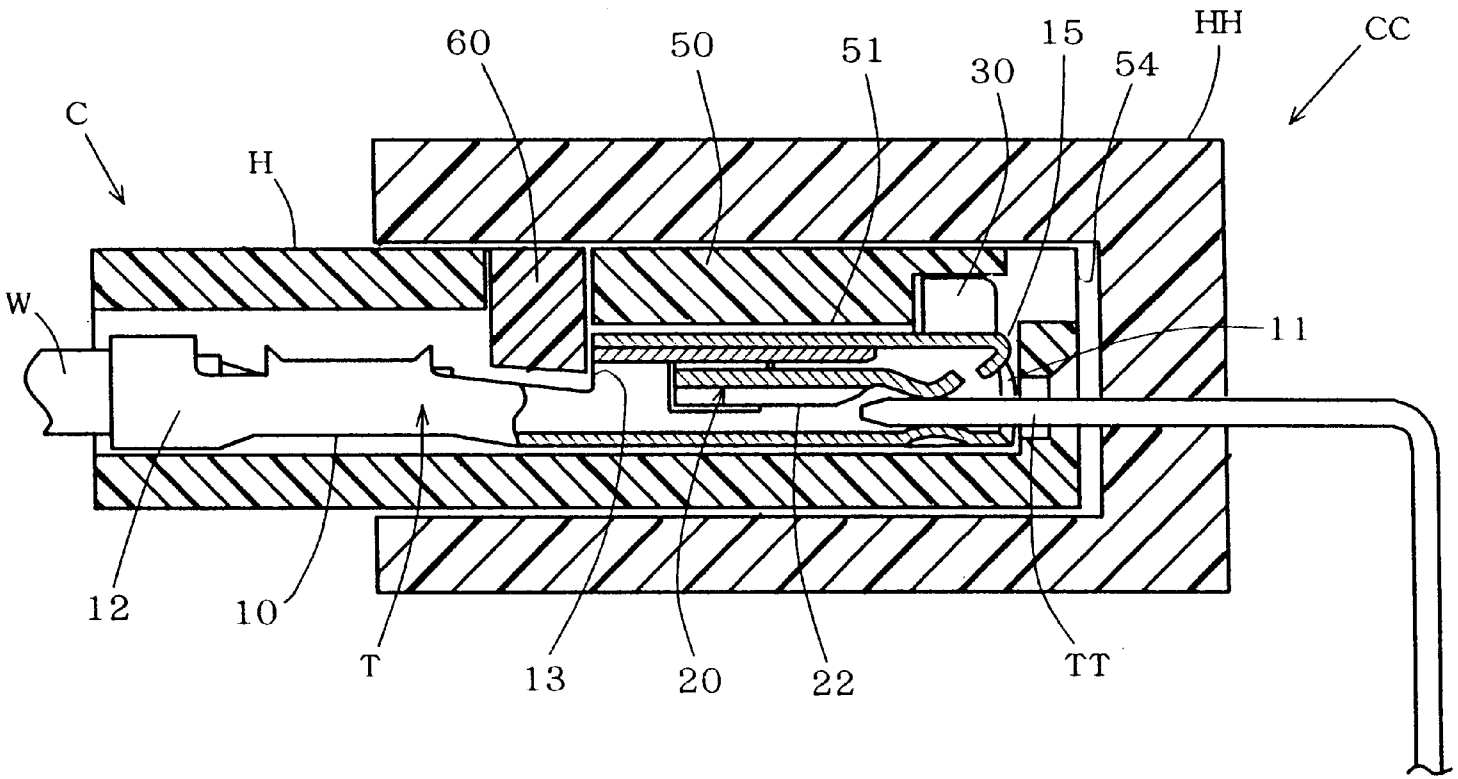
FIG. 1 is a fragmentary longitudinal sectional view showing a connector of the first embodiment being connected with a counterpart connector.
Figure 2:
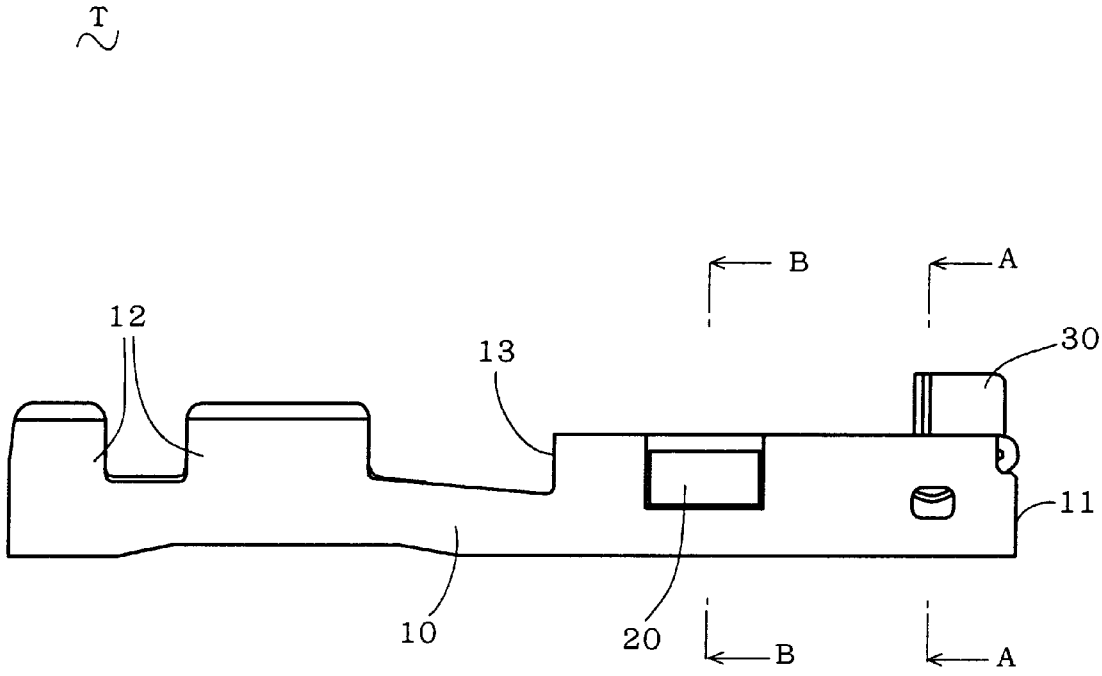
FIG. 2 is a left side view of the female terminal of the first embodiment.
Figure 3:
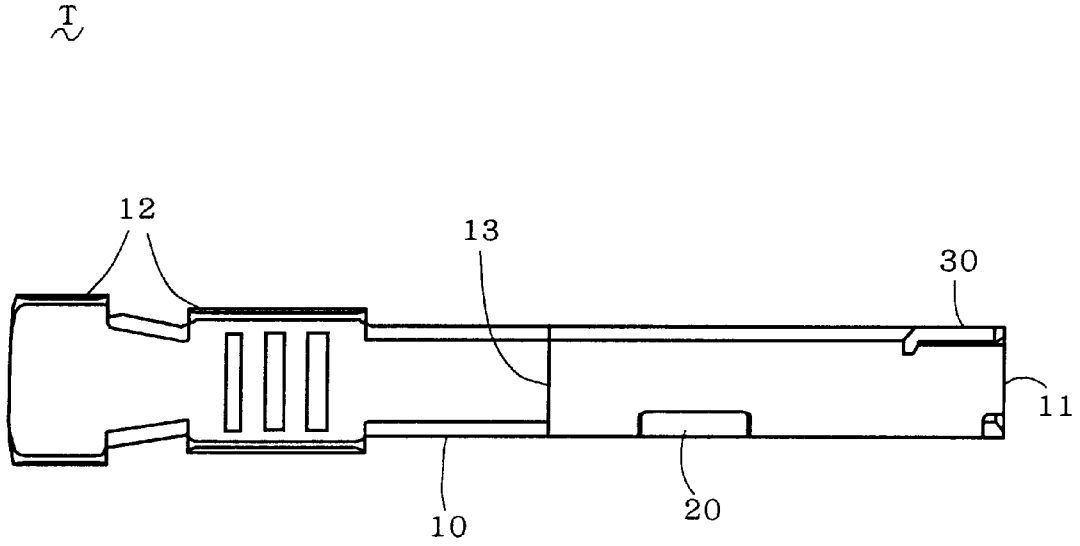
FIG. 3 is a plan view of the female terminal of the first embodiment.
Figure 4:
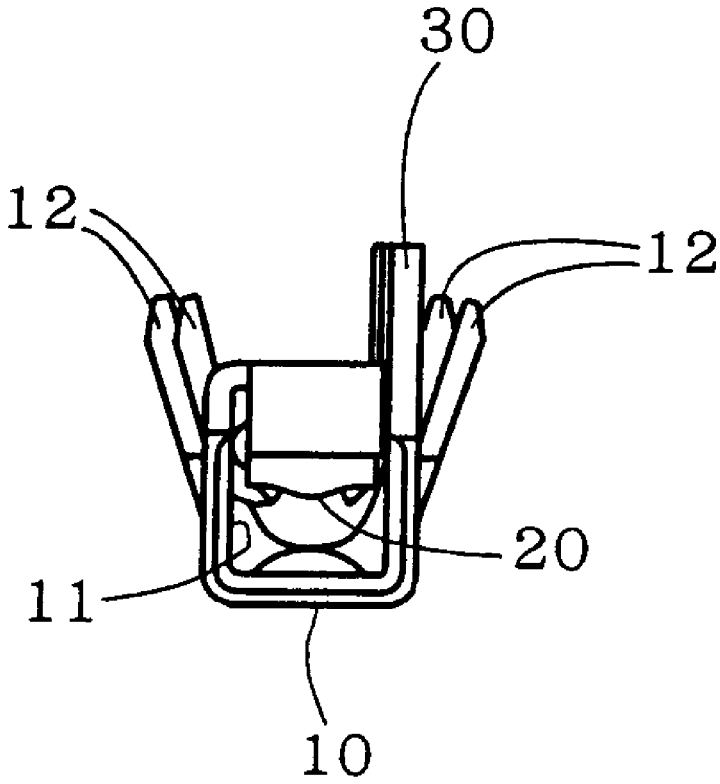
FIG. 4 is a front view of the female terminal of the first embodiment.
Figure 5A:
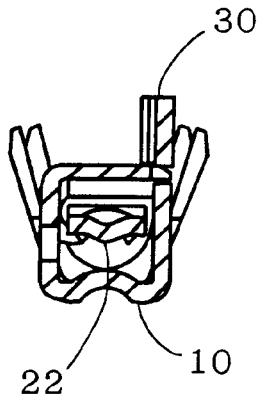
FIG. 5A is a sectional view along the line A—A of FIG. 2.
Figure 5B:
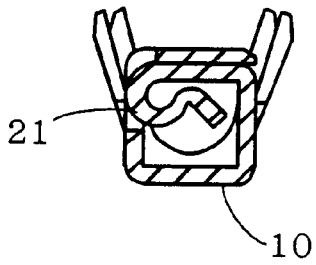
FIG. 5B is a sectional view along the line B—B of FIG. 2.
Figure 6:
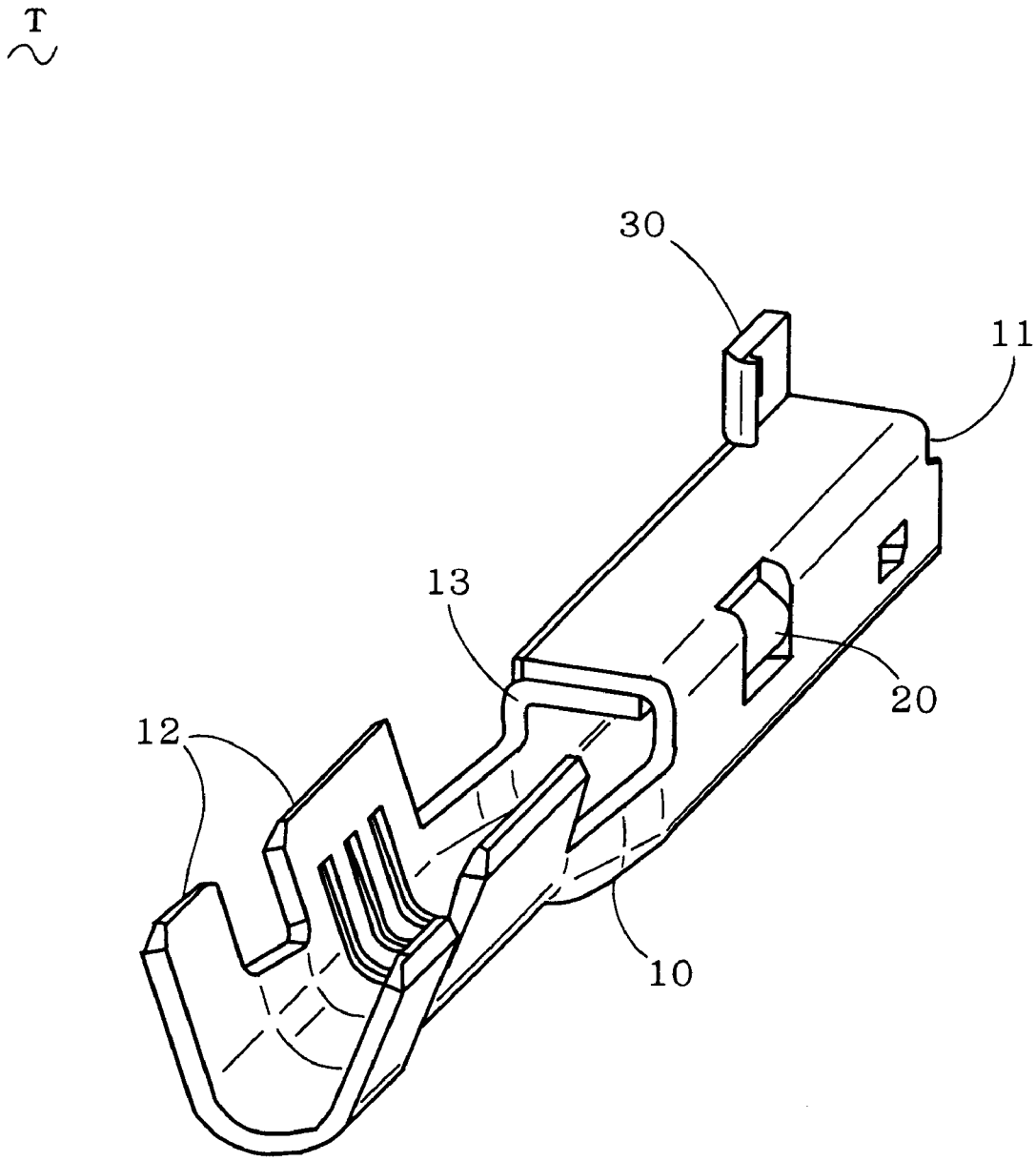
FIG. 6 is a perspective view showing the female terminal of the first embodiment seen from a point behind, on the left and above.
Figure 7:
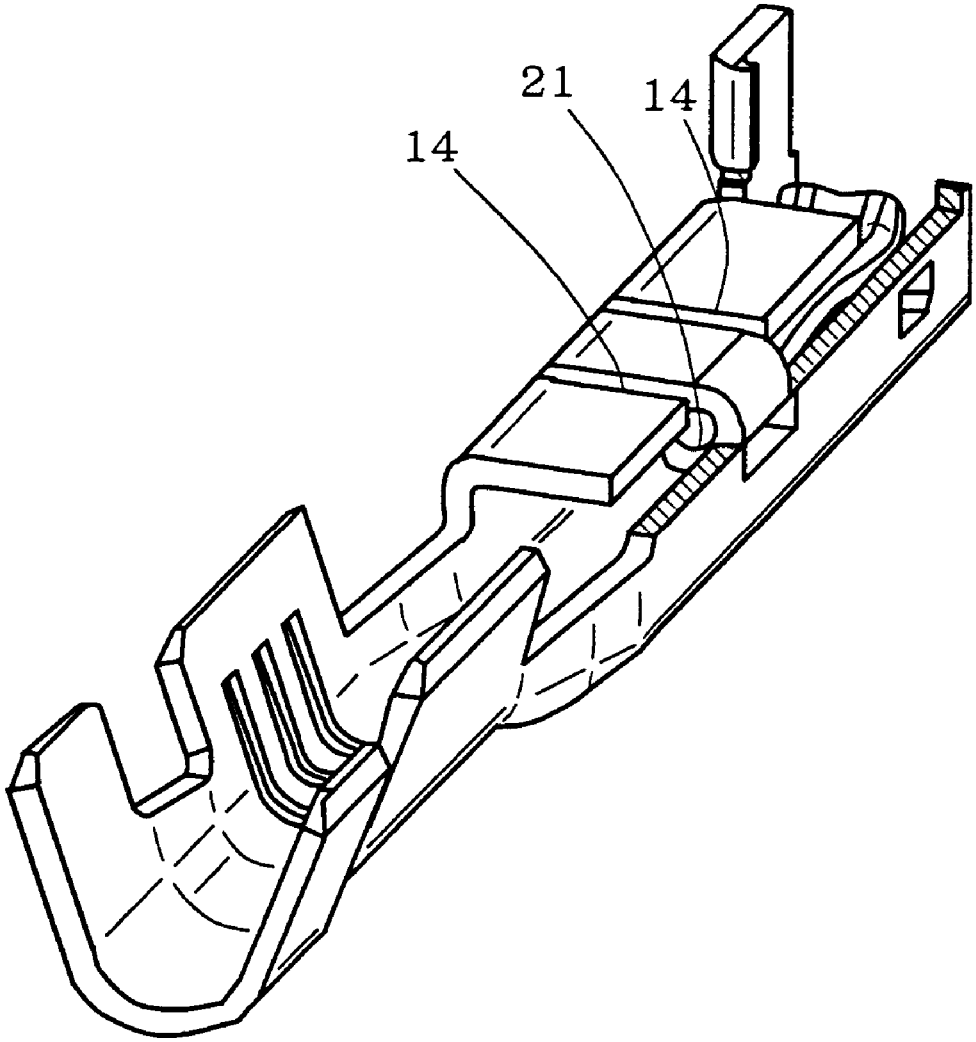
FIG. 7 is a perspective view of the female terminal of FIG. 6. The external wall of the front half part of the terminal proper is not shown.
Figure 8:
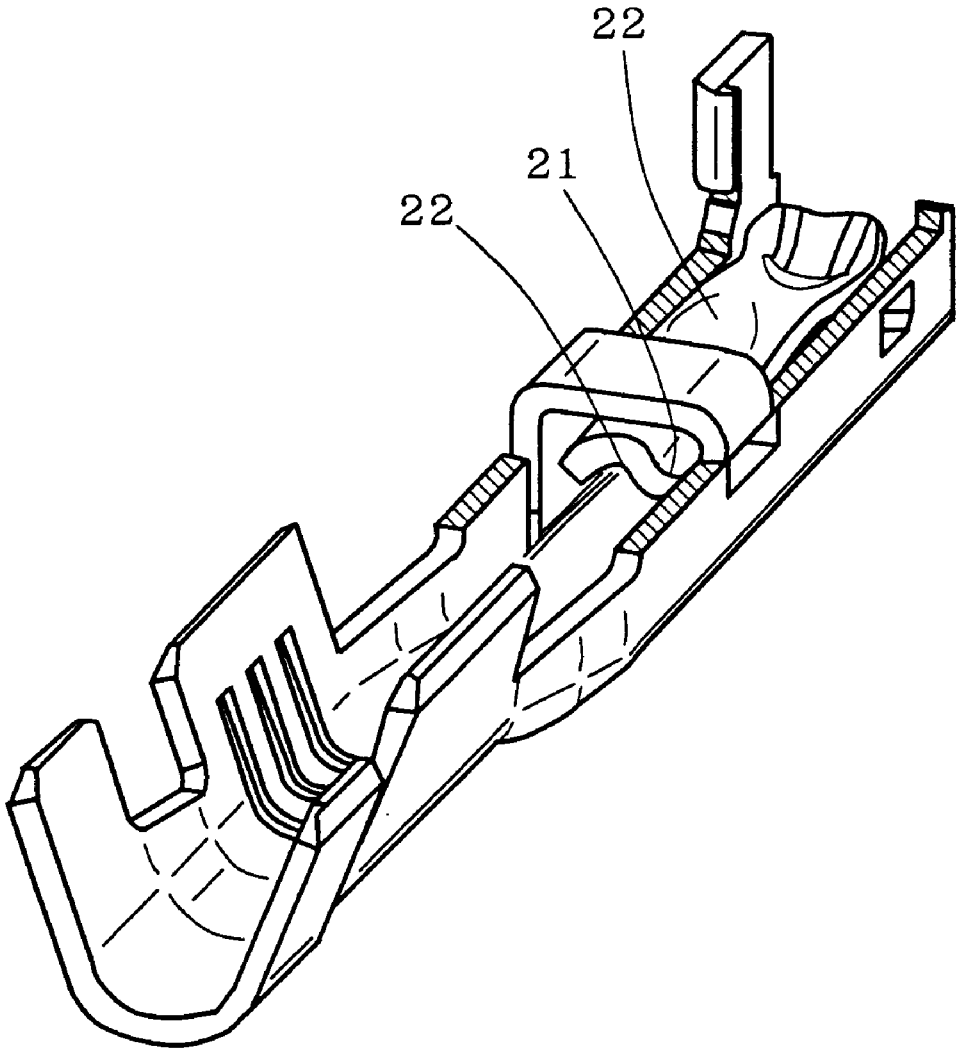
FIG. 8 is a perspective view of the female terminal of FIG. 7. The internal wall of the front half part of the terminal proper is not shown.
Figure 10A:
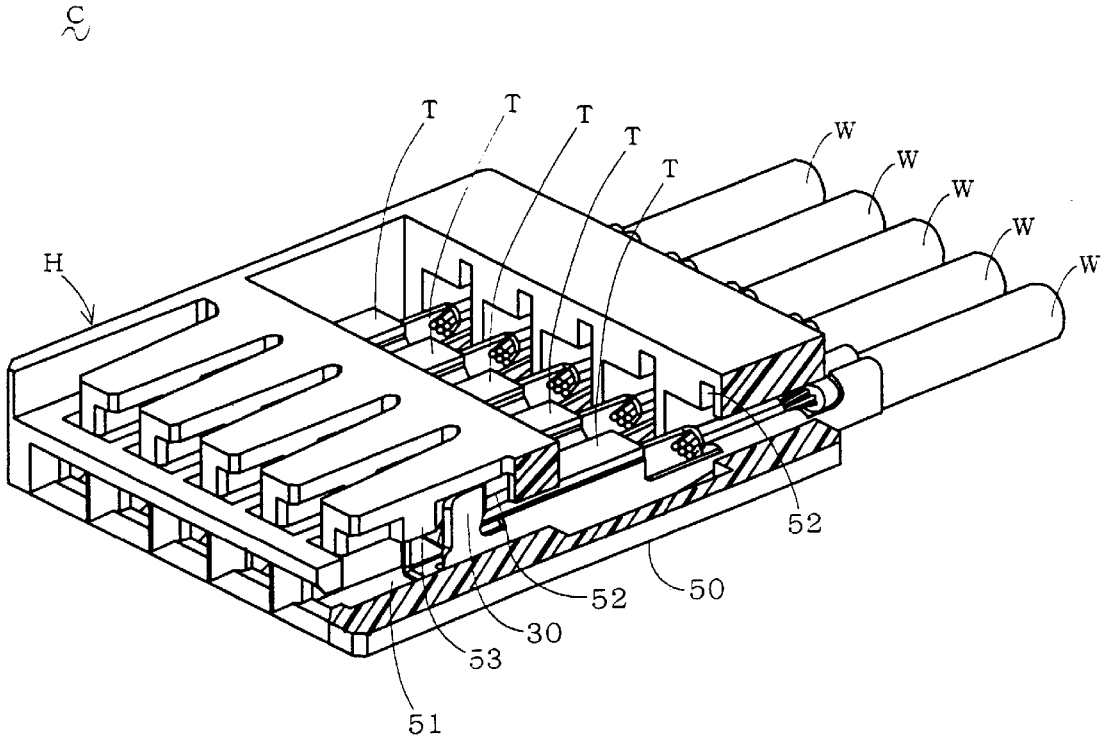
FIG. 10A is a perspective view of the female terminal of the first embodiment. The female terminal is being inserted into the housing. It is seen from a point in front, on the right and above. The retainer is not shown.
Figure 10B:
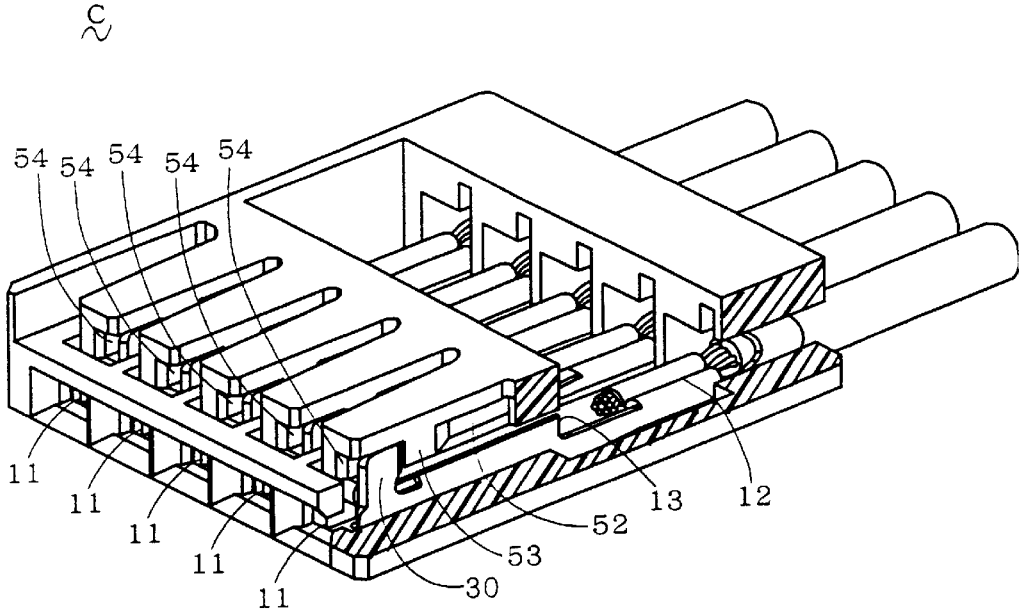
FIG. 10B is a similar perspective view of the female terminal after completion of insertion. In both diagrams, a part of the chamber on this side is cut away.

In the following, embodiments of the present invention will be described with reference to the attached drawings. FIG. 2 through FIG. 6 show a female terminal T of a connector C of the first embodiment. FIG. 1, FIG. 10A and FIG. 10B show the connector C wherein this female terminal T is inserted in a housing H.

As shown in FIG. 2 through FIG. 6, the female terminal T is provided with a terminal body 10 having an approximately tubular front half part that can be inserted into a chamber 51 of the housing H, a leaf spring 20 of which a root end is integral to the front half of the terminal body 10, and a stabilizer 30 being on the outer side of the terminal body 10. It should be noted that with regard to the female terminal T, the front-rear direction is the longitudinal direction. For example, in FIG. 4, it is the direction perpendicular to the paper. The direction of height substantially corresponds to the direction of flexing of the top end of the leaf spring 20; for example, in FIG. 3, it is the direction perpendicular to the paper. The direction of width substantially corresponds to the direction of width of the top end of the leaf spring 20; for example, in FIG. 2, it is the direction perpendicular to the paper. This system of directions is also applied to the housing H. Hence the front-rear direction, the height direction and the width direction of the female terminal T that is inserted in the chamber 51 are the front-rear direction, the height direction and the width direction of the chamber 51 of the housing H, respectively.

A port 11 is opened in the front end of the above-mentioned terminal body 10 to receive a male terminal TT. A splicing part 12 for connecting an electric wire W is provided in the back thereof. This splicing part 12 is formed to have an approximately U-shaped section. Its upper edge portions are bent inward to crimp the conductor of the electric wire W. A longitudinally intermediate part of the terminal body 10 is provided with a fixing part 13 into which a retainer 60 of the housing H is to be fitted. This fixing part 13 is formed into an approximately U-shape when seen from the side. As the upper edges of the fixing part 13 are formed to be lower than the upper wall of the front half part of the terminal proper 10, the retainer 60 can be fitted into the fixing part 13 as shown in FIG. 1.

As shown in FIG. 1, FIG. 5A, FIG. 5B and FIG. 8, the top end of the above-mentioned leaf spring 20 extends forward inside the front half part of the terminal body 10 and can be flexed in the height direction. When a male terminal TT is inserted, the top end of the leaf spring 20 will be pressed to contact the male terminal TT. At the root end of the leaf spring 20, a round part 21, that bends around an axis approximately parallel to the front half part into an approximately circular arc in a position beyond the reach of the male terminal TT, is formed. A bead 22 that has a curved section to increase the flexural rigidity is formed ahead of the round part 21 of the leaf spring 20. Here bending around an axis approximately parallel to the front half part means bending in such a way that displacement takes place in the direction of height. The round part 21 is formed into an approximately circular arc around an axis that is in the front-rear direction of the terminal body 10. Examples of the sectional forms of the above-mentioned bead 22 include approximately U-shaped form, approximately W-shaped form and their inverted forms. What is important is that when the leaf spring 20 is sectioned along a plane in the front-rear direction the moment of inertia of area along a neutral axis passing sidewise in the middle, in the thickness direction, of the leaf spring 20 is greater than that of a flat plate. Slits 14, 14 are formed in a portion of terminal body 10 that is continuous to the round part 21 from both side edges of the round part's root end in the width direction of the terminal body 10. At the top end of the above-mentioned terminal body 10, when necessary, a guide 15 is formed to cover a gap between the top end of the leaf spring 20 and the inner wall of the terminal body 10. This guide 15 prevents inadvertent insertion of the male terminal TT or a screwdriver for inspection, etc. into the gap.

As shown in FIG. 1, FIG. 10A and FIG. 10B, when the terminal body 10 is inserted into the chamber 51 of the housing H, the above-mentioned stabilizer 30 will fit into a groove 52 that is formed in the front-rear direction and moves forward beyond a lance 53 that is formed in the groove. The stabilizer 30 will reach a position in front of the lance 53 and will be fixed there by the lance 53. The stabilizer 30 having a face in the width direction is erected in the height direction at the front end of the terminal body 10. In the present embodiment, the stabilizer 30 is provided on the upper side of the terminal proper 10.

Figure 12A:
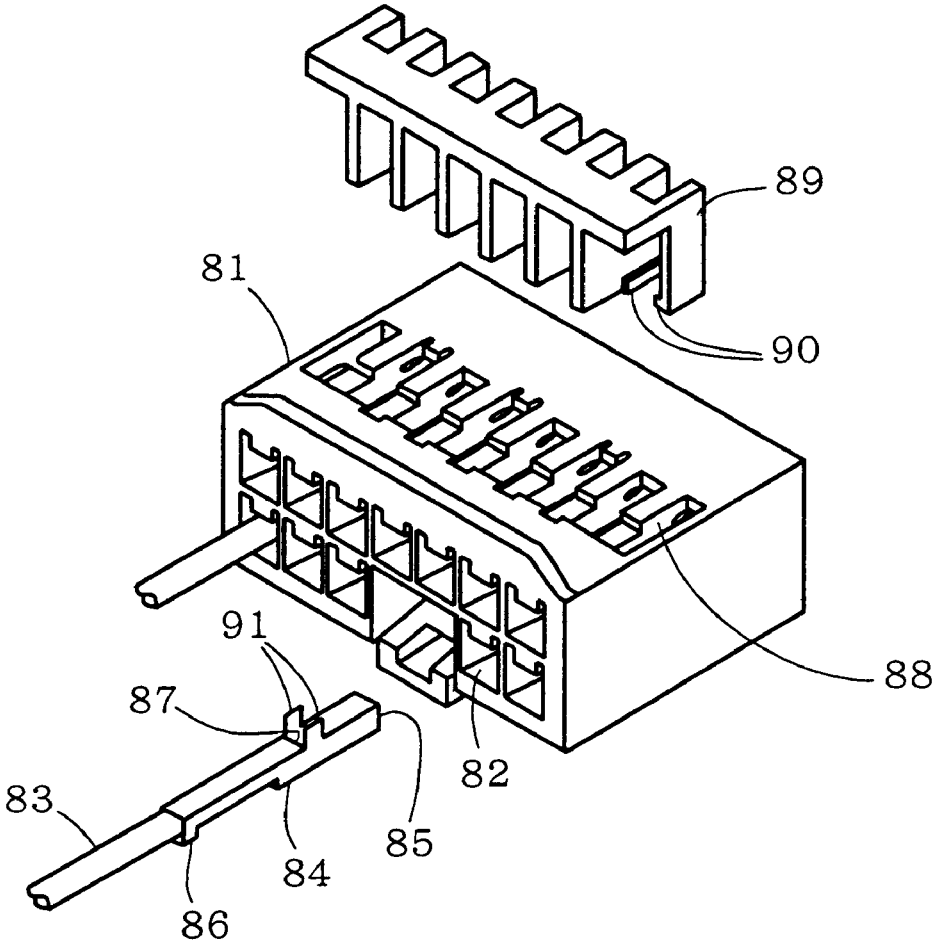
FIG. 12A prior art
FIG. 12A is a perspective view showing insertion of a conventional female terminal into a housing.
Figure 12B:
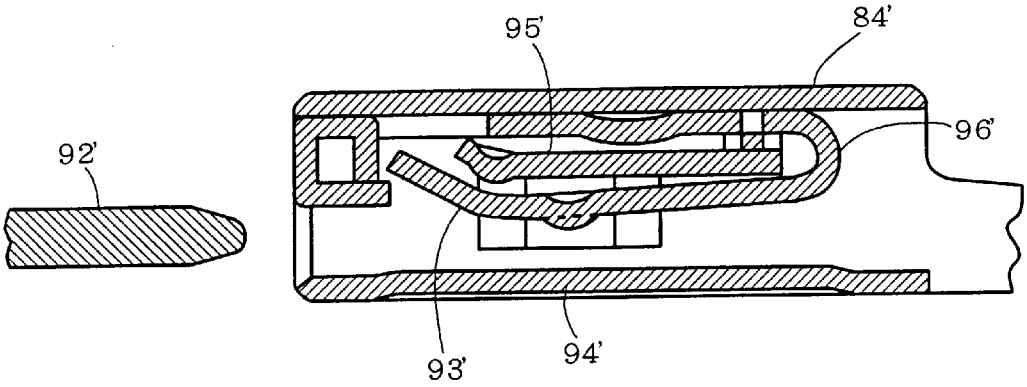
FIG. 12B prior art
FIG. 12B is a longitudinal sectional view of another conventional female terminal before insertion of a male terminal.
Figure 12C:
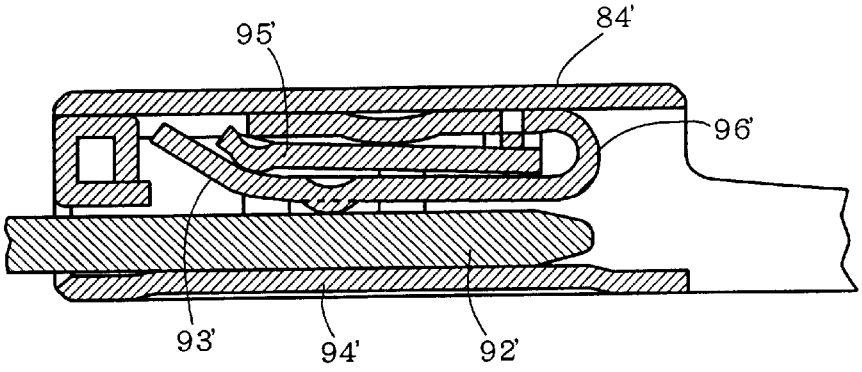
FIG. 12C prior art
FIG. 12C is a longitudinal sectional view of the conventional female terminal after insertion of the male terminal.

As shown in FIG. 1, FIG. 10A and FIG. 10B, the above-mentioned housing H comprises a housing body 50 in which through chambers 51 are formed in the front-rear direction and a retainer 60 that fits into the housing body 50 and penetrates into the chambers 51. The above-mentioned housing proper 50 is provided with grooves 52 that are made in the height direction from the chambers, extend in the front-rear direction and receive the stabilizers 30, lances 53 that are formed in respective grooves to be flexed in the width direction of the chambers 51 and fix the stabilizers 30 by the front sides, and testing windows 54 that allow access to the grooves 52 in front of the lances 53 from the front side. The above-mentioned grooves 52 are formed upward from the chambers 51. In FIG. 10A and FIG. 10B, the exemplifying connector C has a single row of parallel chambers 51 arranged in the width direction. However, as shown in FIG. 12A, such rows of chambers 51 may be arranged in several columns in the height direction.

Figure 9:
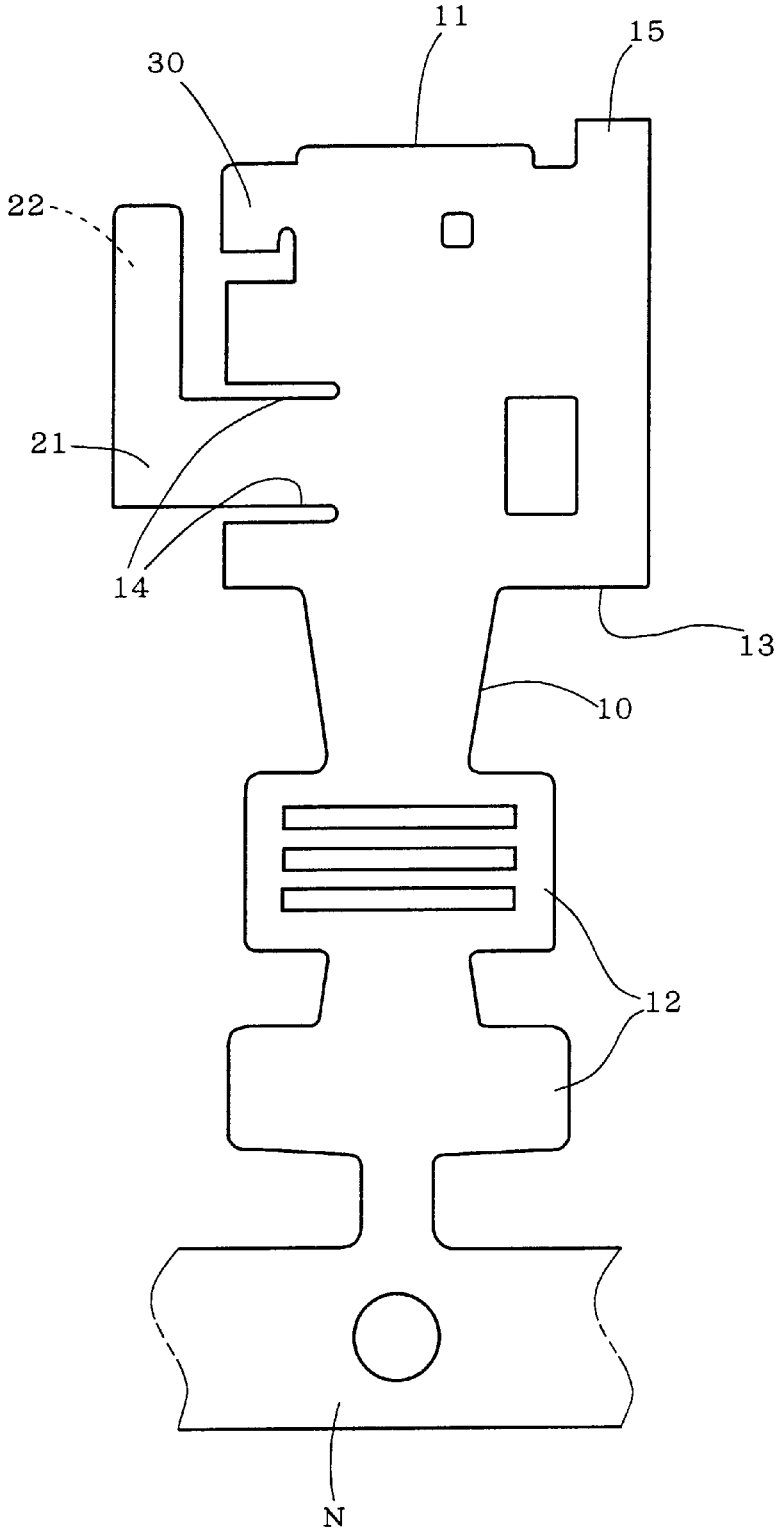
FIG. 9 is a diagram showing the development of the female terminal of the first embodiment. It shows the female terminal before bending.

The above-mentioned female terminal T is formed from a single piece or blank of sheet metal. As shown in FIG. 9, plural female terminals T, T . . . in a developed form, with a runner connecting them together, are blanked out of a sheet metal. Next, various parts are bent to form the female terminals T, T . . . into the final shape. After that, the respective female terminals T are separated from the runner N.

In the above-mentioned first embodiment, after an electric wire W is connected to the splicing part 12 of the terminal body 10, when the female terminal T is inserted into a chamber 51 of the housing H, the stabilizer 30 will fit into a groove 52 of the housing H (the state shown in FIG. 10A), then the stabilizer 30 will go beyond a lance 53 of the housing H and will be fixed by the lance 53. This is the primary fixing of the female terminal T to the housing H (the state shown in FIG. 10B). Next, when the retainer 60 is forced into the housing H, the retainer 60 will fit into the fixing part 13 of the terminal body 10. This is the secondary fixing of the female terminal T to the housing H. When this connector C is opposed to a counterpart connector CC and its male terminals TT, TT . . . are inserted into the female terminals T, T . . . , each leaf spring 20 will press to contact a male terminal TT to make mechanical connections and electric connections between both connectors C, CC (the state shown in FIG. 1).

In that case, as the bead 22 is formed beyond the round part 21 of the leaf spring 20 on the top end side thereof, the flexural rigidity of the leaf spring 20 is greater and a sufficient contacting force is provided without provision of a reinforcing spring. Moreover, as no reinforcing spring is provided, the spring constant has no point of inflection, and the contacting force of each product is stabilized. Furthermore, as the flexural rigidity of the leaf spring 20 is greater, a sufficient contacting force is generated even if a contacting part of the leaf spring 20 is shifted forward close to the port. As a result, the length of insertion of the male terminal TT is shortened, and in turn, the housing HH of the counterpart connector CC that contains the male terminal TT is shortened and made more compact and the tolerance to slant of the male terminal TT is also increased. This reduces troubles that a male terminal TT cannot be inserted into a female terminal T. Thus the yield of connectors CC can be improved. Moreover, as the round part 21 is formed in a position beyond the reach of the male terminal TT, the radius of curvature of the round part 21 can be set larger by extensively using the interior of the front half part of the terminal body in the height direction. This prevents generation of cracks in the round part 21 and stabilizes the contacting force. As the stabilizer 30 is provided at the top end of the terminal body 10, if the female terminal T is inserted into a chamber 51 of the housing H in a wrong orientation, the stabilizer 30 will catch on the entrance of the chamber 51 in the initial stage of insertion. Thus inverse insertion of the female terminal T is prevented reliably, and any damage to the housing H due to incorrect operation of the worker assembly be avoided. Furthermore, as the test window 54 that directly leads to the stabilizer 30 is opened in the front of the housing H, when a test jig having a shape identical to that of the male terminal TT is inserted into the test window 54, the test jig will contact the stabilizer 30. Thus a continuity test, etc. can be carried out without giving any damage to the leaf spring, etc. As no reinforcing spring is used, the height of the female terminal T is lowered, and as the round part 21 is in a position beyond the reach of the male terminal TT and it does not require any space for the male terminal TT to move into beneath the leaf spring 20, the height of the female terminal T can be lowered further. Moreover, as the lance 53 of the housing H is flexed in the direction of width by the stabilizer 30 having a face set in the direction of width, there is no need of providing a space for flexing in the direction of height of the housing and the height can be reduced. As a result, the connector C can be made more compact in the direction of height as much as possible. In particular, in the connector C wherein chambers 51 are arranged in the direction of height, several female terminals T are arranged in succession in the direction of height, and the number of walls between chambers 51 is larger. When the height of each female terminal T is lowered and the walls between chambers 51 are made thinner, the connector C can be made more compact significantly in the direction of height. Because of this, the connector C is suitable as a connector for automobiles in which higher space utility is rigorously demanded. When the stabilizer 30 is provided on the lower side of the terminal body 10, the groove 52 is made downward from the chamber 51 and the lance 53 is provided to flex in the direction of width of the chamber 51, the connector C can be made more compact in the direction of height just like the above-mentioned embodiment.

When the female terminal T is to be blanked out of a sheet metal, it is necessary to make sure that the respective parts do not interfere with each other in the developed form. These restraints may impair the degree of freedom of design. However, when the round part 21 is bent into an approximately circular arc around an axis that is in the front-rear direction of the terminal body 10 as is the case of the above-mentioned first embodiment, as shown in FIG. 9, if the female terminal T is formed from a single sheet metal, the leaf spring 20 and the splicing part 12 in the developed form of the female terminal T hardly interfere with each other. Thus the degree of freedom of design is enhanced.

Connectors of this kind may undergo wear caused by microsliding. When a pair of connectors being connected with each other are subjected to temperature changes, they will undergo thermal deformation. As a result, the contacting surfaces of the female terminal and the male terminal slip relative to each other. When this is repeated, oxide films that are formed near the contacting surfaces will peel eventually. This is microsliding wear. Accumulation of this oxide film eventually causes imperfect contact. To prevent this, one way is to increase the contacting force of the leaf spring so that the slip hardly occurs. This, however, demands a large force in connecting the connectors together. It will be hard to use connectors having a large number of terminals. However, as is the case in the above-mentioned first embodiment, when slits 14, 14 are formed in a portion of terminal body 10 that is continuous to the round part 21 from both side edges of the round part's root end in the direction crossing the front-rear direction, the round part 21 shifts a little in the front-rear direction due to a deformation of the portion of the terminal body between slits 14, 14. This shift absorbs thermal deformation due to temperature changes which otherwise would cause the contacting faces of the leaf spring 20 and the male terminal TT to slip relative to each other. Thus the microsliding wear hardly occurs. Accordingly, imperfect contact due to oxide films hardly occurs. This means a high durability in, for example, an area of harsh temperature changes. In this case, as there is no need of microsliding wear preventive measures, such as increasing the contacting force of the leaf spring 20 by, for example, changing the radius of curvature of the round part 21, the force required for connecting the connector C can be set adequately and workability can be enhanced. Moreover, a connector C with a large number of terminals can be set.

Figure 11:
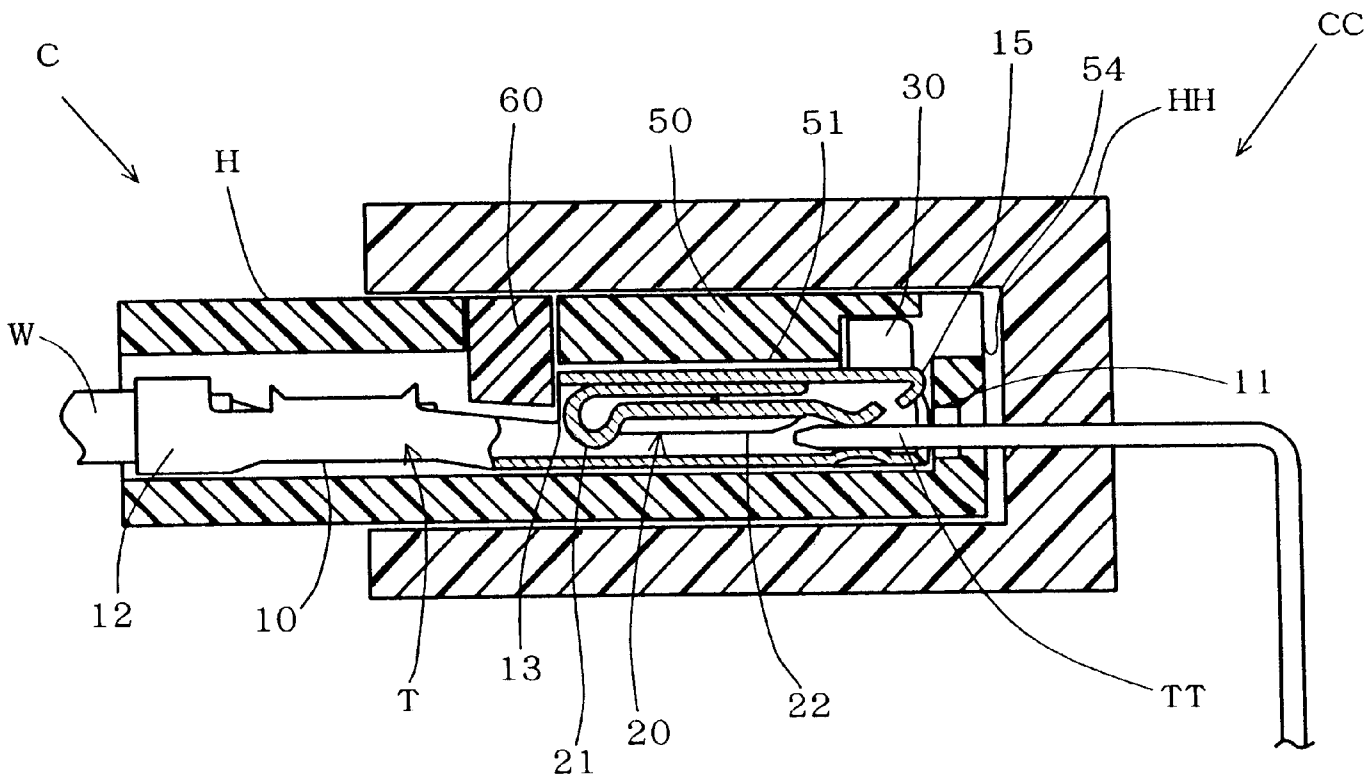
FIG. 11 is a longitudinal sectional view showing a connector of the second embodiment. The connector is connected with a counterpart connector.

Next, a second embodiment will be described with reference to FIG. 11. This second embodiment differs from the above- mentioned first embodiment only in the configuration of the round part of the leaf spring, and other configurations are identical. Accordingly, identical reference characters are given to members that exhibit identical functions of the members of the first embodiment. The description of the first embodiment except a portion concerning the configuration of the round part of the leaf spring is applicable here in its entirety as the description of the configuration of the second embodiment.

The configuration of the round part of the leaf spring of the second embodiment will be described. As shown in FIG. 11, the round part 21 of the second embodiment is formed by bending a portion into an approximately circular arc around an axis that is in the right-left direction of the terminal body 10, and slits 14, 14 are not formed.

In this second embodiment, as the round part 21 is bent into an approximately circular arc around an axis that is in the right- left direction, it is necessary to some extent to consider interference between the leaf spring 20 and the splicing part 12 in the developed form of the female terminal T. Moreover, as slits 14, 14 are not formed, microsliding-wear-preventive effects of the slits are not available. However, other operations and actions of the second embodiment are similar to those of the first embodiment. Hence the descriptions concerning them applicable here in their entirety as the descriptions of the operations and actions of the second embodiment.

The present invention includes an embodiment that is the first embodiment except no slits are formed and an embodiment that is the second embodiment with formation of slits. In the first embodiment, the round part 21 is formed by bending into an approximately circular arc around an axis that is in the front-rear direction of the terminal body 10, and in the second embodiment, the round part 21 is formed by bending into an approximately circular arc around an axis that is in the left-right direction of the terminal body 10, but the present invention includes all embodiments having a round part that bends around an axis approximately parallel to the front half part into an approximately circular arc in a position beyond the reach of any male terminal.

What is claimed is:

1. A female terminal for a connector that is adapted to be inserted into a chamber of a housing of a connector and adapted to receive a male terminal, said female terminal comprising a terminal body having a tubular front half part that can be inserted into the chamber of the housing, having a port that opens in a front end of said terminal body and is adapted to receive the male terminal, having a splicing part that is at a rear end of said terminal body and is adapted to be connected to an electric wire, and having a fixing part adapted to have a retainer of the housing fit therein, a leaf spring having a root end that is integral to said front half part of said terminal body, having a top end that extends forward inside said front half part of said terminal body in a longitudinal direction, and that is adapted to be flexed in a direction of height perpendicular to said longitudinal direction, a stabilizer protruding in said direction of height on an outer side at said front end of said terminal body, having a face surface oriented to face in a direction of width perpendicular to said direction of height and to said longitudinal direction, and adapted to fit into a groove formed in said longitudinal direction in the housing and adapted to advance beyond a lance of the housing that is formed in the groove and adapted to be fixed by the lance when said terminal body is inserted into the chamber of the housing, a round part that is formed at said root end of said leaf spring and bent around an axis into an approximately circular arc in a position beyond a reach of the male terminal, and a bead that is formed ahead of said round part of said leaf spring between said root end and a tip end of said leaf spring on a top end side of said leaf spring and that has a curved section on a section plane normal to said longitudinal direction to increase a flexural rigidity of said leaf spring.

2. A combination of the female terminal of claim 1 and a housing of a connector into which said female terminal is inserted, said housing comprising a housing body having through chambers formed in a front-rear direction parallel to said longitudinal direction, having grooves that extend parallel to said height direction from said chambers and in said front-rear direction and that receive said stabilizers, having lances that are formed in said grooves and adapted to be flexed parallel to said width direction of said chambers and to fix said stabilizers by front sides thereof, and having test windows that allow access to said grooves in front of said lances from a front side, and a retainer that fits into said housing body and penetrates into said chambers.

3. The female terminal for a connector of claim 1, characterized in that said round part is bent around said axis which extends approximately parallel to said longitudinal direction.

4. A combination of the female terminal of claim 3 and a housing of a connector into which said female terminal is inserted, said housing comprising a housing body having through chambers formed in a front-rear direction parallel to said longitudinal direction, having grooves that extend parallel to said height direction from said chambers and in said front-rear direction and that receive said stabilizers, having lances that are formed in said grooves and adapted to be flexed parallel to said width direction of said chambers and to fix said stabilizers by front sides thereof, and having test windows that allow access to said grooves in front of said lances from a front side, and a retainer that fits into said housing body and penetrates into said chambers.

5. The female terminal for a connector of claim 3, characterized in that slits are formed in a portion of said terminal body that is continuous to said round part from both side edges of said root end in said width direction.

6. A combination of the female terminal of claim 5 and a housing of a connector into which said female terminal is inserted, said housing comprising a housing body having through chambers formed in a front-rear direction parallel to said longitudinal direction, having grooves that extend parallel to said height direction from said chambers and in said front-rear direction and that receive said stabilizers, having lances that are formed in said grooves and adapted to be flexed parallel to said width direction of said chambers and to fix said stabilizers by front sides thereof, and having test windows that allow access to said grooves in front of said lances from a front side, and a retainer that fits into said housing body and penetrates into said chambers.

7. The female terminal for a connector of claim 1, characterized in that said round part is bent around said axis which extends substantially parallel to said width direction.

8. A combination of the female terminal of claim 7 and a housing of a connector into which said female terminal is inserted, said housing comprising a housing body having through chambers formed in a front-rear direction parallel to said longitudinal direction, having grooves that extend parallel to said height direction from said chambers and in said front-rear direction and that receive said stabilizers, having lances that are formed in said grooves and adapted to be flexed parallel to said width direction of said chambers and to fix said stabilizers by front sides thereof, and having test windows that allow access to said grooves in front of said lances from a front side, and a retainer that fits into said housing body and penetrates into said chambers.

9. An electrical connector terminal, comprising a single integral metal component that has a front end and a rear end, and that comprises:

a splicing part at said rear end that is adapted to be connected to an electric wire;

a tubular front part at said front end that extends integrally from said splicing part lengthwise in a longitudinal direction of said electrical connector terminal;

a leaf spring having a root end and opposite thereto a tip end, wherein said leaf spring extends in said longitudinal direction in a hollow interior of said tubular front part, with said root end oriented toward said rear end and with said tip end oriented toward said front end;

a bent part that integrally connects said root end of said leaf spring with said tubular front part, and that includes a rounded part with an arcuate curvature;

wherein a portion of said leaf spring extending between said root end and said tip end has a curved sectional shape in a section plane normal to said longitudinal direction so as to stiffen said leaf spring.

10. The electrical connector terminal of claim 9, wherein said arcuate curvature of said rounded part arcs around an axis parallel to said longitudinal direction.

11. The electrical connector terminal of claim 9, wherein said arcuate curvature of said rounded part arcs around an axis perpendicular to said longitudinal direction.

12. The electrical connector terminal of claim 9, including only a single spring member, which consists of said leaf spring and said bent part.

* * * * *

UNITED STATES PATENT AND TRADEMARK OFFICE

CERTIFICATE OF CORRECTION

PATENT NO. : 6,174,208

DATED : January 16, 2001

INVENTOR(S) : Chen

It is certified that error appears in the above-identified patent and that said Letters Patent is hereby corrected as shown below:

On the Title Page, Item (73) The Assignee's city should read: Osaka-shi

| | | |
|---|---|---|
| Col. 2, | line 19, | after "in", delete --a--; |
| Col. 2, | line 21, | after "on", delete --to--; |
| Col. 3, | line 2, | before "body", insert --terminal--; |
| Col. 3, | line 3, | after "being", replace "adopted" by --adapted--; |
| Col. 3, | line 6 , | after "face", insert --oriented--; |
| Col. 3, | line 9, | after "when", replace "said terminal proper" by --the terminal body--; |
| Col. 3, | line 11, | before "leaf" replace "said" by --the--; |
| Col. 3, | line 12, | before "front", replace "said" by --the--; |
| Col. 3, | line 14, | before "male", replace "said" by --the--; |
| Col. 3, | line 14, | after "of", replace "said" by --the--; |
| Col. 3, | line 15, | after "of", replace "said" by --the--; |
| Col. 4, | line 15, | after "can", insert --be--; |
| Col. 4, | line 28, | after "allow", insert --the connector--; |
| Col. 4, | line 28, | after "made", delete --of the connector--; |

UNITED STATES PATENT AND TRADEMARK OFFICE

CERTIFICATE OF CORRECTION

PATENT NO. : 6,174,208

DATED : January 16, 2001

INVENTOR(S) : Chen

It is certified that error appears in the above-identified patent and that said Letters Patent is hereby corrected as shown below:

| | | |
|---|---|---|
| Col. 6, | line 29, | after "terminal", replace "proper" by --body--; |
| Col. 6, | line 35, | after "housing", replace "proper" by --body--; |
| Col. 7, | line 37, | before "be", replace "worker assembly" by --assembly worker can--; |
| Col. 7, | line 66, | after "is", replace "made" by --provided--; |
| Col. 9, | line 8, | after "them", insert --are--; |
| Col. 11, | line 13, | after "front end;" insert --and--. |

Signed and Sealed this

Fifteenth Day of May, 2001

*Attest:*

Nicholas P. Godici

NICHOLAS P. GODICI

*Attesting Officer*

*Acting Director of the United States Patent and Trademark Office*